US009714818B2

(12) United States Patent
Mook et al.

(10) Patent No.: US 9,714,818 B2
(45) Date of Patent: Jul. 25, 2017

(54) NOCK AND NOCK RECEIVER

(71) Applicant: Hunter's Manufacturing Company, Inc., Suffield, OH (US)

(72) Inventors: Dean Mook, Suffield, OH (US); Gregory S. Ans, Macedonia, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/343,480

(22) Filed: Nov. 4, 2016

(65) Prior Publication Data

US 2017/0131072 A1 May 11, 2017

Related U.S. Application Data

(60) Provisional application No. 62/251,729, filed on Nov. 6, 2015.

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | |
|---|---|---|---|
| 2,209,672 | A | 7/1940 | Boggs |
| 2,484,589 | A | 10/1949 | Richards |
| 3,034,789 | A | 5/1962 | Moore |
| 3,214,174 | A | 10/1965 | Saunders |
| 3,658,335 | A | 4/1972 | Saunders |
| 4,305,588 | A | 12/1981 | Dodge |
| 4,544,163 | A | 10/1985 | Scanlon |
| 4,656,994 | A | 4/1987 | Jenks |
| 4,874,180 | A | 10/1989 | Fingerson et al. |
| 4,943,067 | A | 7/1990 | Saunders |
| 5,067,731 | A | 11/1991 | Bickel |
| 5,154,432 | A | 10/1992 | Saunders |
| 5,186,470 | A | 2/1993 | Easton et al. |
| 5,306,019 | A | 4/1994 | Guest et al. |
| 5,306,020 | A | 4/1994 | Bolf |
| 5,417,439 | A | 5/1995 | Bickel |
| 5,803,843 | A | 9/1998 | Anderson et al. |
| 5,987,724 | A | 11/1999 | Kleman |
| 6,203,457 | B1 | 3/2001 | Snook |
| 6,364,499 | B1 | 4/2002 | Jones |

(Continued)

FOREIGN PATENT DOCUMENTS

KR 2010 0138335 12/2010

OTHER PUBLICATIONS

Canadian Office Action for CA Application No. 2,795,149 for "Nock Device for Bow".

(Continued)

*Primary Examiner* — John Ricci
(74) *Attorney, Agent, or Firm* — Emerson Thomson Bennett LLC

(57) ABSTRACT

An arrow nock and nock receiver assembly may include first and second interconnections each including a groove portion and a finger. The fingers may have lips that are received in the groove portions. The connection between the nock and nock receiver may provide relative rotational alignment between the nock receiver and the nock as well as relative longitudinal alignment between the nock receiver and the nock.

20 Claims, 7 Drawing Sheets

(56) References Cited

U.S. PATENT DOCUMENTS

| | | | |
|---|---|---|---|
| 6,669,585 | B2 | 12/2003 | Sutherland et al. |
| 7,189,170 | B1 | 3/2007 | Korsa et al. |
| 7,922,609 | B1 | 4/2011 | Hajari |
| 7,931,550 | B2 | 4/2011 | Lynch |
| 8,038,552 | B2 | 10/2011 | Song |
| 8,257,208 | B2 | 9/2012 | Harding |
| 8,622,855 | B2 | 1/2014 | Bednar et al. |
| 8,845,464 | B1 | 9/2014 | Hyde |
| 8,944,944 | B2 | 2/2015 | Pedersen et al. |
| 9,028,347 | B2 | 5/2015 | Pedersen |
| 9,074,837 | B2 | 7/2015 | Bednar et al. |
| 9,140,527 | B2 | 9/2015 | Pedersen et al. |
| 9,243,875 | B2 | 1/2016 | Minica |
| 9,453,700 | B2 | 9/2016 | Bednar et al. |
| 9,470,486 | B2 | 10/2016 | Bednar et al. |

OTHER PUBLICATIONS

European Search Report for EP Application No. 12191687.8 for "Nock for an Arrow".
English translation of Foreign Reference: KR2010-0138335.

NOCK AND NOCK RECEIVER

This application claims the benefit of U.S. Provisional Patent Application No. 62/251,729 filed Nov. 6, 2015, entitled NOCK AND NOCK RECEIVER.

I. BACKGROUND

A. Field of the Invention

This invention relates generally to arrows that are shot or fired by bowstrings attached to bows, crossbows and the like. More particularly, this invention relates to methods and apparatuses used to attach nocks to arrows.

B. Description of Related Art

It is known to provide arrows with nocks. Nocks have a bowstring reception surface that is contacted by a bowstring in order to fire the arrow.

II. SUMMARY

According to some embodiments of this invention, an arrow nock and nock receiver assembly may comprise: A) a nock comprising: a longitudinal axis; a bowstring reception surface designed to receive a bowstring to fire an associated arrow; and a connection surface; B) a nock receiver comprising: a longitudinal axis; a first connection surface designed to connect the nock receiver to the associated arrow; and a second connection surface; C) a first interconnection comprising: (1) a first groove portion that is formed on one of the nock and the nock receiver; and (2) a first finger that: (a) extends from the other of the nock and the nock receiver; and (b) has a lip sized and shaped to be received in the first groove portion; and, D) a second interconnection comprising: (1) a second groove portion that is formed on one of the nock and the nock receiver; and (2) a second finger that: (a) extends from the other of the nock and the nock receiver; and (b) has a lip sized and shaped to be received in the second groove portion. The second connection surface of the nock receiver may be designed to engage the connection surface of the nock to provide relative rotational alignment between the nock receiver and the nock. The first and second interconnections may be designed to provide relative longitudinal alignment between the nock receiver and the nock. The first and second fingers may be separated by a circumferentially positioned longitudinally extending space when the nock receiver and the nock are rotationally and longitudinally aligned.

According to other embodiments of this invention, an arrow nock and nock receiver assembly may comprise: A) a nock comprising: a longitudinal axis; a bowstring reception surface designed to receive a bowstring to fire an associated arrow; and a connection surface; B) a nock receiver comprising: a longitudinal axis; a first connection surface designed to connect the nock receiver to the associated arrow; and a second connection surface; C) first and second groove portions formed on one of the nock and the nock receiver; D) first, second and third fingers that extend from the other of the nock and the nock receiver; and E) first and second lips that: (1) extend from the first and second fingers, respectively; and (2) are shaped and sized to be received in the first and second groove portions, respectively. The second connection surface of the nock receiver may designed to engage the connection surface of the nock to provide relative rotational alignment between the nock receiver and the nock. The first and second fingers may be flexible. The first and second lips may be designed to engage the first and second groove portions, respectively, to provide relative longitudinal alignment between the nock receiver and the nock. The third finger may be non-flexible and may be positioned circumferentially between the first and second fingers when the nock receiver and the nock are rotationally and longitudinally aligned. The first and third fingers may be separated by a circumferentially positioned longitudinally extending space when the nock receiver and the nock are rotationally and longitudinally aligned. The second and third fingers may be separated by a circumferentially positioned longitudinally extending space when the nock receiver and the nock are rotationally and longitudinally aligned.

According to still other embodiments of this invention, an arrow nock and nock receiver assembly may comprise: A) a nock comprising: a longitudinal axis and a bowstring reception surface designed to receive a bowstring to fire an associated arrow; B) a nock receiver comprising a longitudinal axis and a first connection surface designed to connect the nock receiver to the associated arrow; C) first and second groove portions formed on one of the nock and the nock receiver; D) a first finger: (1) formed on the one of the nock and the nock receiver; and (2) circumferentially positioned between the first and second groove portions; and E) second and third fingers that: (a) extend from the other of the nock and the nock receiver; and (b) have lips sized and shaped to be received in the first and second groove portions, respectively. The first finger may be designed to be circumferentially positioned between the second and third fingers to provide relative rotational alignment between the nock receiver and the nock. The lips of the second and third fingers may be designed to engage the first and second groove portions, respectively, to provide relative longitudinal alignment between the nock receiver and the nock.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Embodiments that may be used to attach a nock to an arrow are disclosed in Pub. No.: US 2015/0018140, U.S. patent application Ser. No. 14/075,244 entitled "METHOD AND APPARATUS FOR ALIGNING ARROW NOCKS", which is incorporated herein by reference in its entirety. In Pub. No.: US 2015/0018140 a nock is combined with an insert/receiver which is then attached to an end of an arrow. The nock may have an extension with a connection surface that is connectable to the receiver, and a head having a bowstring reception surface that is designed to receive a bowstring. The connection surface may be formed on the outer surface of the extension and may be semi-triangular in shape with three planar portions and three curved portions. Each curved portion may be positioned between two planar portions. The receiver may have a head and an extension with a connection surface that is connectable to the arrow. An opening may extend through the head and the extension. The opening may be designed to receive the nock extension. Thus, the opening in the head may have three planar portions and three curved portions arranged to match the nock planar and curved portions. As a result, in order to insert the nock into the receiver, the planar portions and curved portions must be properly aligned. This assures proper alignment of the nock with respect to the arrow vanes. An LED-battery combination component may be used.

Figure 1:
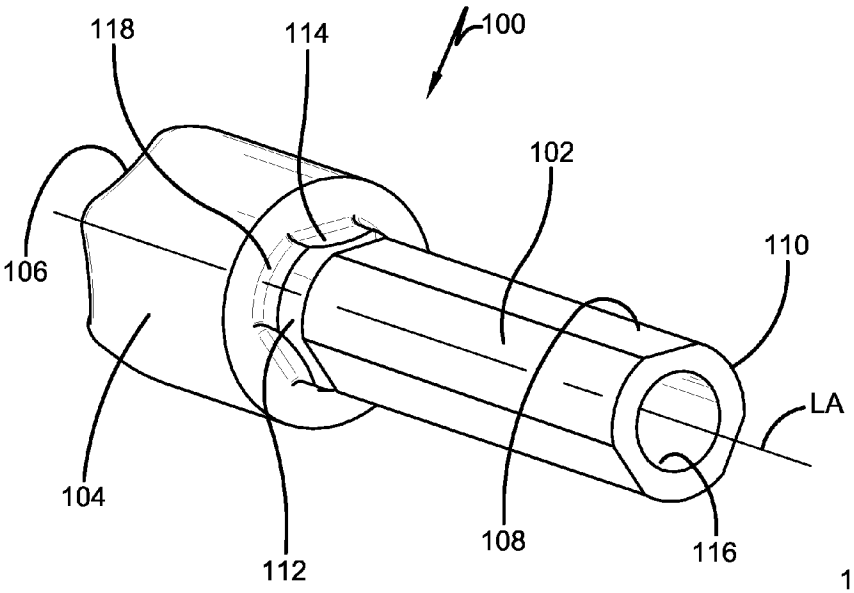
FIG. 1 is a perspective view of a nock according to some embodiments of this invention.
Figure 2:
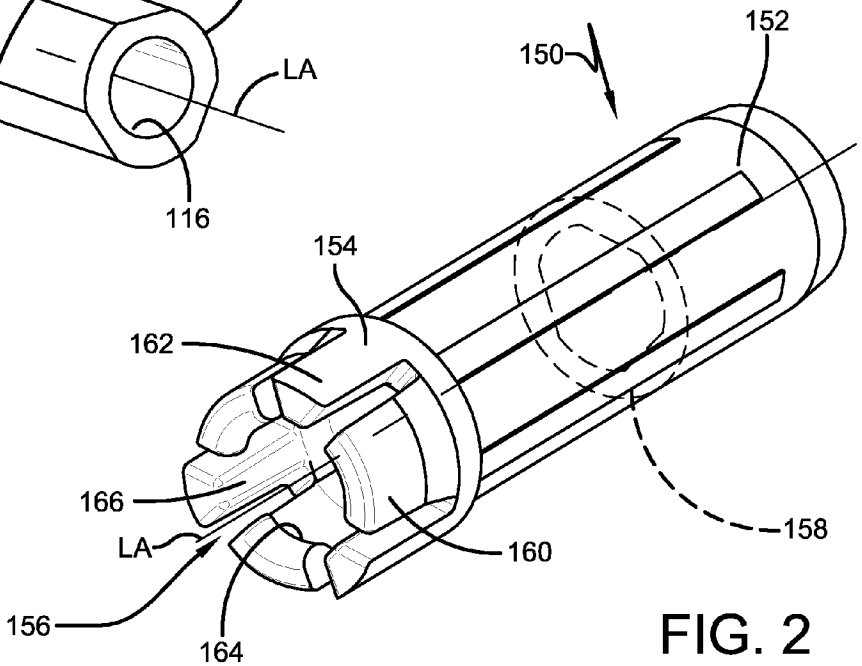
FIG. 2 is a perspective view of a receiver according to some embodiments of this invention.
Figure 3:
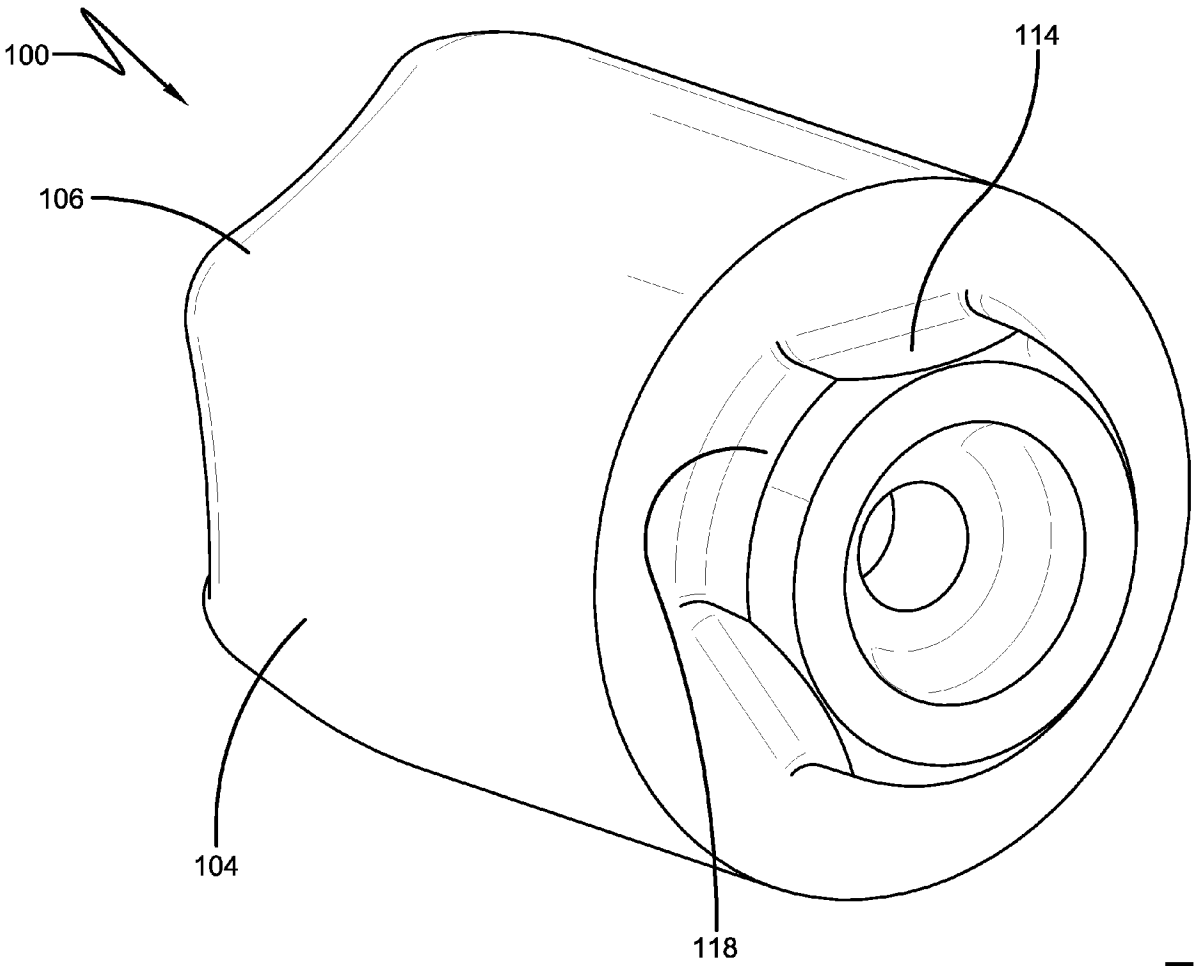
FIG. 3 is a sectional view of the nock shown in FIG. 1 taken along the nock groove portions.
Figure 4:
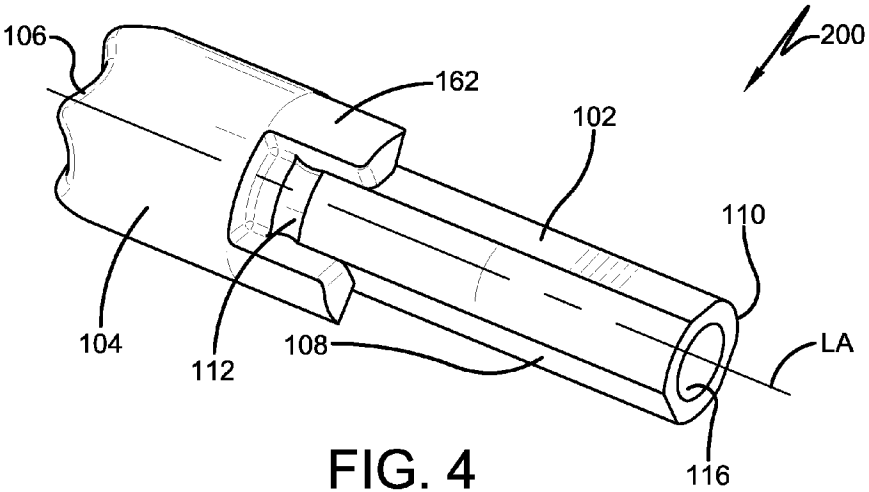
FIG. 4 is a perspective view of a nock according to some embodiments of this invention.
Figure 5:
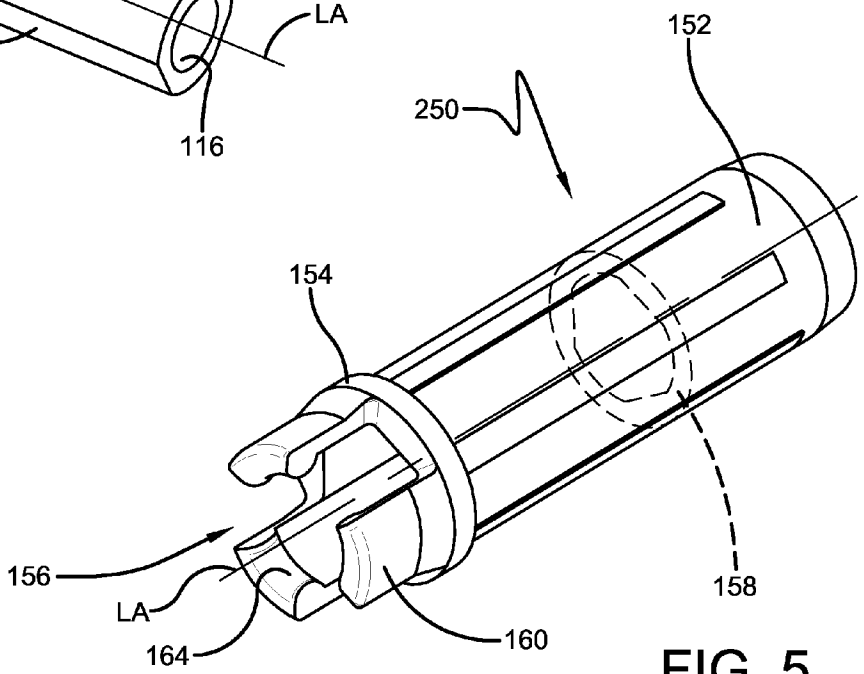
FIG. 5 is a perspective view of a receiver according to some embodiments of this invention.

Referring now to the drawings wherein the showings are for purposes of illustrating embodiments of the invention only and not for purposes of limiting the same, and wherein like reference numerals are understood to refer to like components, FIGS. 1-3 show other embodiments that combine a nock 100 with a receiver 150. The nock 100 may have a longitudinal axis LA, an extension with a connection surface 102 that is connectable to the receiver 150 and a head 104 having a bowstring reception surface 106 that is designed to receive a bowstring. The bowstring reception surface 106 may be of any design chosen with the sound judgment of a person of skill in the art. In one embodiment, the bowstring reception surface 106 is similar to the bowstring reception surface disclosed in the previously described Pub. No.: US 2015/0018140. The bowstring reception surface may, in some embodiments, be similar to the bowstring reception surface 107 shown in FIGS. 7, 10, 12 and 13.

With reference no to FIGS. 1 and 3, the extension may be hollow having an opening 116. In some embodiments, not shown, the opening 116 may receive an LED-battery combination component which may be similar to the LED-battery combination component disclosed in the previously described Pub. No.: US 2015/0018140. The connection surface 102 may be formed on the outer surface of the extension, as shown, and may be semi-triangular in shape with three planar portions 108 and three curved portions 110. Each curved portion 110 may be positioned between two planar portions 108, as shown. In other embodiments, one (or more) planar portion 108 is sufficient and one (or more) curved portion 110 is sufficient. One or more groove portions 112 may be formed on the nock 100. In some embodiments the groove portions 112 may be part of a single groove that extends around the circumference of the nock 100. In other embodiments the groove portions 112 may be separate. The groove portions 112 may be formed in the extension near the head 104. Each groove portion 112 may be perpendicular to the longitudinal axis of the nock 100, as shown. The planar portions 108 may extend on the other side of the groove portions 112 as shown at 114. The curved portion 110 may also extend on the other side of the groove portions 112 as shown at 118. FIG. 3 is a sectional view through the groove portions 112 looking toward the head 104.

With reference now to FIGS. 1 and 2, the receiver 150 may have a longitudinal axis LA, an extension with a connection surface 152 that is connectable to an arrow (not shown) and a head 154. A connection surface 156 may, in some embodiments, be designed to engage the connection surface 102 of the nock 100 to provide relative rotational alignment between the nock receiver 150 and the nock 100. When relative rotational alignment is achieved (see FIG. 12), the nock and nock receiver cannot be rotated with respect to each other about the longitudinal axis LA. Instead, when relative rotationally aligned, the nock 100 and nock receiver 150 can only be rotated together about the longitudinal axis LA. The connection surface 156 may be an opening that may extend through the head 154 and into the extension. The opening 156 may be designed to receive the nock 100 extension. Thus, the opening 156 may have one or more planar portions to match the planar portions in the nock (three planar portions shown) and one or more curved portions to match the curved portions in the nock (three curved portions shown) as indicated at reference 158. In this way, the nock surfaces 108, 110 are aligned within the opening 156 in the receiver 150. The head 154 may include a number of fingers. For the embodiment shown, there are two types of fingers, finger 160 and finger 162. For the embodiment shown there is a narrow circumferentially positioned space between each of the fingers. Finger 160 may be flexible and may have an inwardly extending lip 164 at its distal end. By "flexible" it is meant that the finger 160 may be relatively easily moved outwardly and inwardly. The finger 160 may be biased toward the inward position so that it maintains contact with the nock 100 when it is attached thereto. Each lip 164 may be sized to be received within a groove portion 112 of the nock 100. Finger 162 may be rigid or non-flexible and may have a planar surface 166 on its inner side. The number of fingers used may be chosen with the sound judgment of a person of skill in the art. For the embodiment shown, there are six total fingers with three fingers 160 and three fingers 162 alternating around the circumference of the receiver 150. When the nock 100 extension is initially inserted into opening 156 of the receiver 150, the nock 100 surfaces 108 and 110 must be aligned with the similar surfaces 158 in the receiver 150. Continued insertion of the nock 100 within the opening 156 causes each lip 164 to be received in a groove portion 112. This limits the distance the nock 100 can be inserted within the receiver 150 providing relative longitudinal alignment between the nock receiver 150 and the nock 100. The operator will "feel" and perhaps hear a sound when the lips 164 are received in a groove portion 112. In this way, the operator has certainty that the nock 100 is properly received within the receiver 150 and properly longitudinally aligned with respect to the receiver 150.

Figure 6:
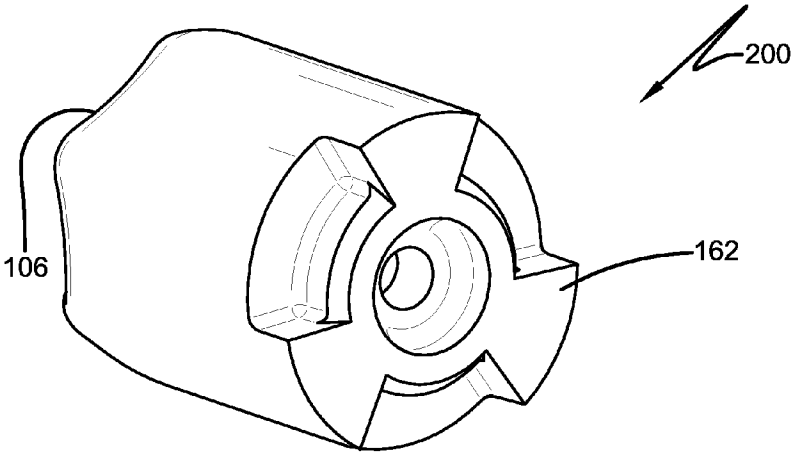
FIG. 6 is a sectional view of the nock shown in FIG. 4 taken along the nock groove portions.
Figure 7:
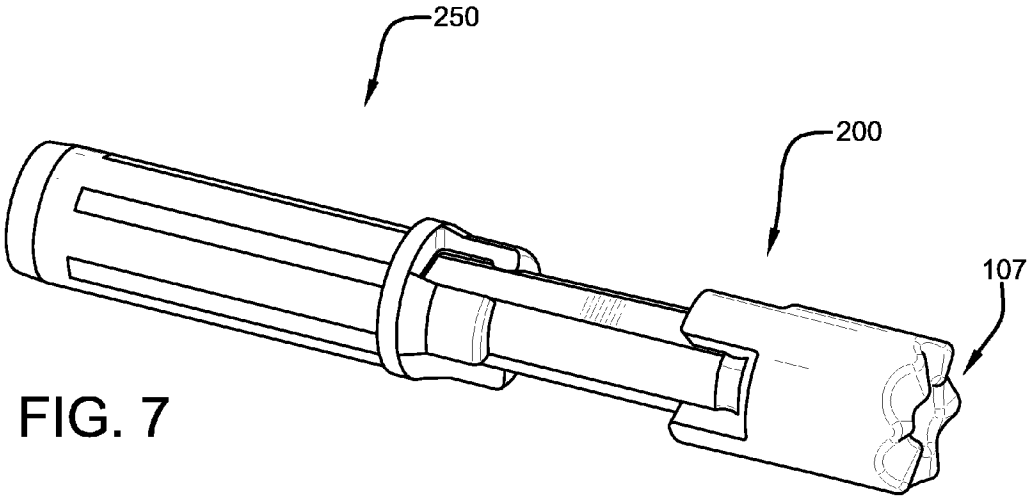
FIG. 7 is a perspective view of the nock shown in FIG. 4 being inserted into the receiver shown in FIG. 5.
Figure 8:
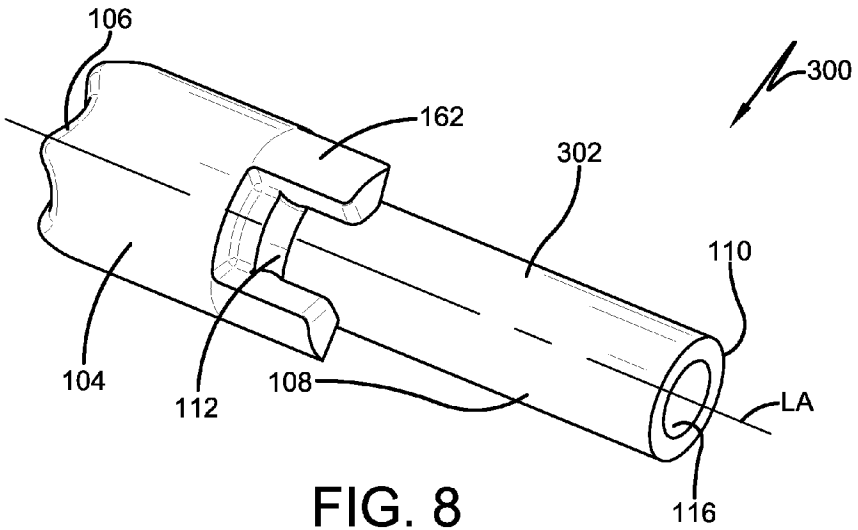
FIG. 8 is a perspective view of a nock according to some embodiments of this invention.
Figure 9:
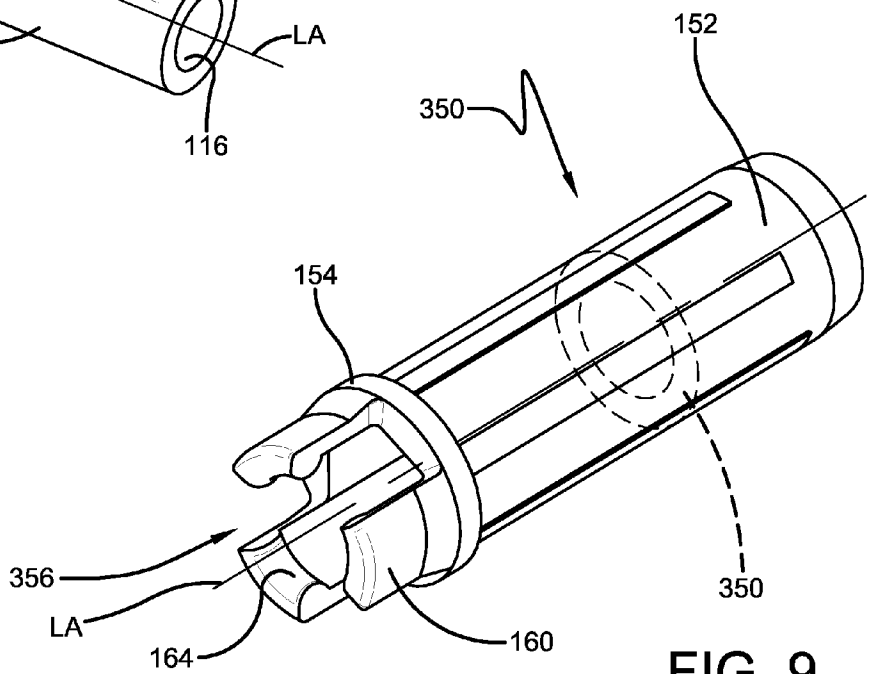
FIG. 9 is a perspective view of a receiver according to some embodiments of this invention.

FIGS. 4-7 show other embodiments that combine a nock 200 with a receiver 250. Many features are similar to those discussed above regarding FIGS. 1-2 so the same reference numbers will be used and an explanation will not be repeated here. Instead, the differences will be described. For this embodiment the rigid or nonflexible fingers 162 are not on the receiver 250 but are positioned instead on the nock 200. They may be fixed to the nock 200. There is thus a larger circumferential space between the fingers 160 on the receiver 250, as shown. This also strengthens the nock 200 at the cross-section through the groove, as shown in FIG. 6. This arrangement of fingers also means that the engagement of one finger on one component (nock or nock receiver) within the open space between two fingers on the other component (nock receiver or nock) will provide relative rotational alignment between the nock receiver and the nock. The operation is otherwise similar to that described above with nock 100 and receiver 150. FIG. 7 shows the nock 200 being inserted into receiver 250.

Figure 10:
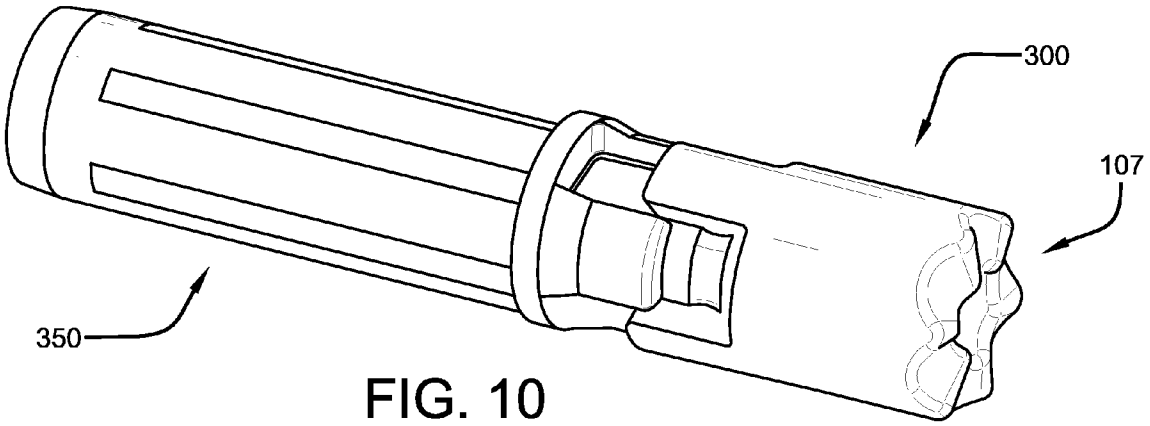
FIG. 10 is a perspective view of the nock shown in FIG. 8 being inserted into the receiver shown in FIG. 9.
Figure 13:
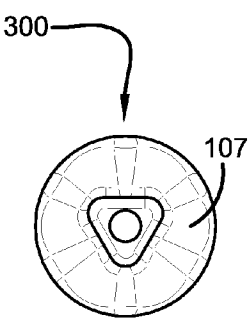
FIG. 13 is an end view taken along the line 13-13 of FIG. 12.
Figure 12:
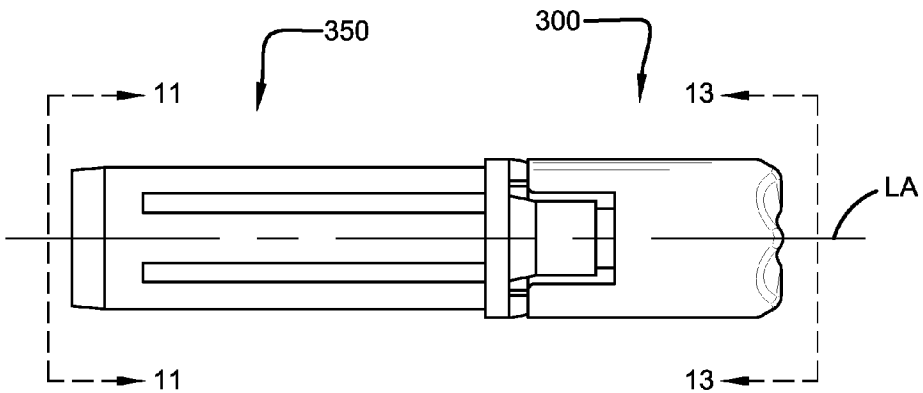
FIG. 12 is a side view of the nock shown in FIG. 8 in the set position with respect to the receiver shown in FIG. 9.
Figure 11:
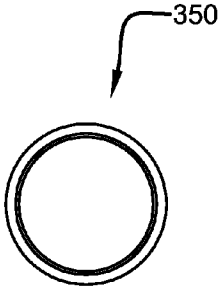
FIG. 11 is an end view taken along the line 11-11 of FIG. 12.
Figure 14:
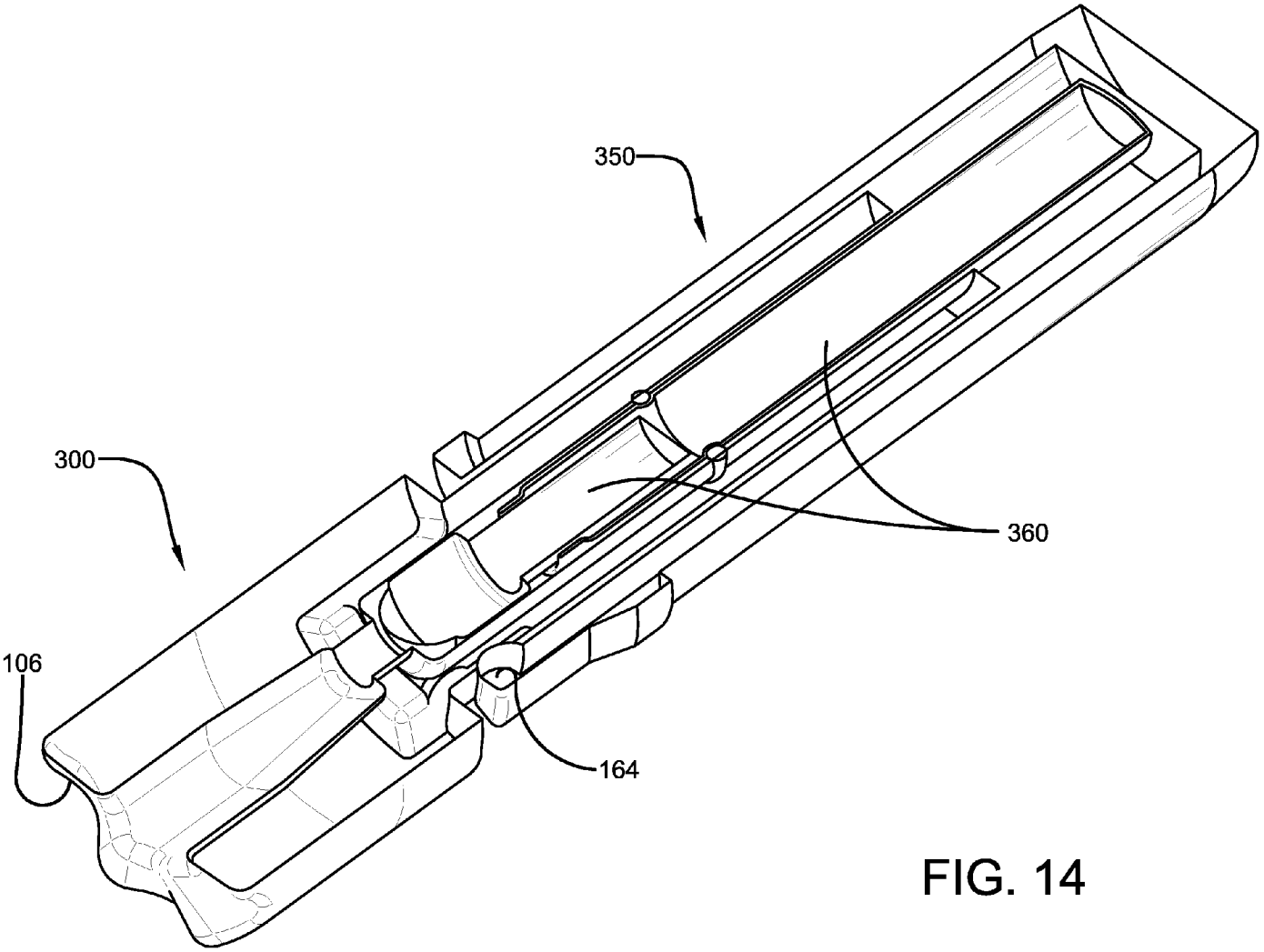
FIG. 14 is a sectional view taken along a longitudinal plane of the nock shown in FIG. 8 inserted into the receiver shown in FIG. 9 and also showing an LED-battery combination component.

FIGS. 8-14 show other embodiments that combine a nock 300 with a receiver 350. Many features are similar to those discussed above regarding FIGS. 4-7 (and thus FIGS. 1-2) so the same reference numbers will be used and an explanation will not be repeated here. Note that the cross-sectional view through the groove facing the head would be the same as shown in FIG. 6. The differences will now be described. In one embodiment, the connection surface 302 on the nock 300 extension has a circular cross-section. The opening 356 in the receiver 350 similarly has a circular shape as indicated at 358. This embodiment has the advantage over previously described embodiments of not requiring relative rotational alignment until the fingers 160, 162 have to interweave. In other words, when the nock 300 extension is initially inserted into opening 356 of the receiver 350, the circular nock 300 connection surface 302 requires no rotational alignment with respect to the circular surface 358 in the receiver 350. As noted above, the interweaving of the fingers provides relative rotational alignment between the nock receiver and the nock. The operation is otherwise similar to that described above with nock 200 and receiver 250. FIG. 10 shows the nock 300 being inserted into receiver 350 and FIG. 12 shows the nock 10 in the set position with respect to the receiver 300. The set position is the position where the nock 300 and receiver 350 are positioned for use with an arrow. FIG. 14 shows a cross-section along a longitudinally extending plane. For these embodiments a LED-battery combination component 360 is provided.

While in the embodiments described above all the fingers (FIG. 2) extend from the nock receiver, or at least the flexible fingers extend from the nock receiver (FIGS. 5 and 9), it should be noted that in other embodiments, not shown, all or any number of fingers, flexible and/or non-flexible, can extend from the nock. Similarly, in other embodiments the groove portions that receive the lips can be positioned on the nock receiver instead of on the nock.

Numerous embodiments of the invention are described above and/or shown in the Figures of the application. Similar features have been numbered with a common reference numeral. Furthermore, particular features of one embodiment can replace corresponding features in another embodiment or can supplement other embodiments unless otherwise indicated by the drawings or this specification. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

We claim:

1. An arrow nock and nock receiver assembly comprising:

a nock comprising: a longitudinal axis; a bowstring reception surface designed to receive a bowstring to fire an associated arrow; and a connection surface;

a nock receiver comprising: a longitudinal axis; a first connection surface designed to connect the nock receiver to the associated arrow; and a second connection surface;

a first interconnection comprising: (1) a first groove portion that is formed on one of the nock and the nock receiver; and (2) a first finger that: (a) extends from the other of the nock and the nock receiver; and (b) has a lip sized and shaped to be received in the first groove portion;

a second interconnection comprising: (1) a second groove portion that is formed on one of the nock and the nock receiver; and (2) a second finger that: (a) extends from the other of the nock and the nock receiver; and (b) has a lip sized and shaped to be received in the second groove portion;

wherein:

(1) the second connection surface of the nock receiver is designed to engage the connection surface of the nock to provide relative rotational alignment between the nock receiver and the nock;

(2) the first and second interconnections are designed to provide relative longitudinal alignment between the nock receiver and the nock; and (3) the first and second fingers are separated by a circumferentially positioned longitudinally extending space when the nock receiver and the nock are rotationally and longitudinally aligned.

2. The arrow nock and nock receiver assembly of claim 1 wherein:

one of the connection surface of the nock and the second connection surface of the nock receiver comprises an extension;

the other of the connection surface of the nock and the second connection surface of the nock receiver comprises an opening that receives the extension;

each of the extension and the opening comprises at least one planar portion and at least one curved portion; and the engagement of the planar portion of the extension with the planar portion of the opening and the curved portion of the extension with the curved portion of the opening provides the relative rotational alignment between the nock receiver and the nock.

3. The arrow nock and nock receiver assembly of claim 1 wherein:

one of the connection surface of the nock and the second connection surface of the nock receiver comprises a third finger;

the other of the connection surface of the nock and the second connection surface of the nock receiver comprises an open space that receives the third finger; and the engagement of the third finger with the open space provides the relative rotational alignment between the nock receiver and the nock.

4. The arrow nock and nock receiver assembly of claim 1 wherein:

the first and second groove portions are formed on one of the nock and the nock receiver;

a planar portion is formed on the one of the nock and the nock receiver and is circumferentially positioned between the first and second groove portions;

the first and second fingers extend from the other of the nock and the nock receiver;

a third finger extends from the other of the nock and the nock receiver and is positioned circumferentially between the first and second fingers;

a portion of the third finger contacts the planar portion when the nock receiver and the nock are rotationally and longitudinally aligned.

5. The arrow nock and nock receiver assembly of claim 1 wherein:

the first groove portion is formed on an outer surface;

the second groove portion is formed on an outer surface;

the first and second fingers extend longitudinally from proximal ends to distal ends; and the lips are positioned on the distal ends of the first and second fingers and extend inwardly.

6. The arrow nock and nock receiver assembly of claim 1 wherein:

the first and second fingers extend longitudinally and are flexible;

a third finger extends longitudinally and is non-flexible;

the third finger is positioned circumferentially between the first and second fingers when the nock receiver and the nock are rotationally and longitudinally aligned.

7. The arrow nock and nock receiver assembly of claim 1 wherein:

the first and second groove portions are formed on one of the nock and the nock receiver;

the first and second fingers extend from the other of the nock and the nock receiver;

a third interconnection comprises: (1) a third groove portion that is formed on the one of the nock and the nock receiver; and (2) a third finger that: (a) extends from the other of the nock and the nock receiver; and (b) has a lip sized and shaped to be received in the third groove portion;

the third interconnection is designed to provide relative longitudinal alignment between the nock receiver and the nock;

the first, second and third groove portions are substantially circumferentially equally spaced around the one of the nock and the nock receiver; and the first, second and third fingers are substantially circumferentially equally spaced around the other of the nock and the nock receiver.

8. The arrow nock and nock receiver assembly of claim 7 wherein:

the first, second and third fingers extend longitudinally and are flexible;

fourth, fifth and sixth fingers extend longitudinally and are non-flexible;

the fourth finger is positioned circumferentially between the first and second fingers when the nock receiver and the nock are rotationally and longitudinally aligned;

the fifth finger is positioned circumferentially between the second and third fingers when the nock receiver and the nock are rotationally and longitudinally aligned; and the sixth finger is positioned circumferentially between the first and third fingers when the nock receiver and the nock are rotationally and longitudinally aligned.

9. An arrow nock and nock receiver assembly comprising:

a nock comprising: a longitudinal axis; a bowstring reception surface designed to receive a bowstring to fire an associated arrow; and a connection surface;

a nock receiver comprising: a longitudinal axis; a first connection surface designed to connect the nock receiver to the associated arrow; and a second connection surface;

first and second groove portions formed on one of the nock and the nock receiver;

first, second and third fingers that extend from the other of the nock and the nock receiver;

first and second lips that: (1) extend from the first and second fingers, respectively; and (2) are shaped and sized to be received in the first and second groove portions, respectively;

wherein:

(1) the second connection surface of the nock receiver is designed to engage the connection surface of the nock to provide relative rotational alignment between the nock receiver and the nock;

(2) the first and second fingers are flexible;

(3) the first and second lips are designed to engage the first and second groove portions, respectively, to provide relative longitudinal alignment between the nock receiver and the nock;

(4) the third finger is non-flexible and is positioned circumferentially between the first and second fingers when the nock receiver and the nock are rotationally and longitudinally aligned;

(5) the first and third fingers are separated by a circumferentially positioned longitudinally extending space when the nock receiver and the nock are rotationally and longitudinally aligned; and (6) the second and third fingers are separated by a circumferentially positioned longitudinally extending space when the nock receiver and the nock are rotationally and longitudinally aligned.

10. The arrow nock and nock receiver assembly of claim 9 wherein:

one of the connection surface of the nock and the second connection surface of the nock receiver comprises an extension;

the other of the connection surface of the nock and the second connection surface of the nock receiver comprises an opening that receives the extension;

each of the extension and the opening comprises at least one planar portion and at least one curved portion; and the engagement of the planar portion of the extension with the planar portion of the opening and the curved portion of the extension with the curved portion of the opening provides the relative rotational alignment between the nock receiver and the nock.

11. The arrow nock and nock receiver assembly of claim 9 wherein:

a planar portion is formed on the one of the nock and the nock receiver and is circumferentially positioned between the first and second groove portions;

the first and second fingers are flexible;

the third finger is non-flexible; and a portion of the third finger contacts the planar portion when the nock receiver and the nock are rotationally and longitudinally aligned.

12. The arrow nock and nock receiver assembly of claim 9 wherein:

the first and second groove portions are formed on an outer surface of the nock;

the first, second and third fingers extend longitudinally from the nock receiver; and the lips are positioned at distal ends of the first and second fingers and extend inwardly.

13. The arrow nock and nock receiver assembly of claim 9 wherein:

a third groove portion is formed on the one of the nock and the nock receiver;

a fourth finger: (a) extends from the other of the nock and the nock receiver; and (b) has a third lip sized and shaped to be received in the third groove portion;

the third lip is designed to engage the third groove to provide relative longitudinal alignment between the nock receiver and the nock;

the first, second and third groove portions are substantially circumferentially equally spaced around the one of the nock and the nock receiver; and the first, second and fourth fingers are substantially circumferentially equally spaced around the other of the nock and the nock receiver.

14. The arrow nock and nock receiver assembly of claim 9 wherein:

a third groove portion is formed on the one of the nock and the nock receiver;

a fourth finger: (a) extends from the other of the nock and the nock receiver; (b) has a third lip sized and shaped to be received in the third groove portion; and (c) is flexible;

the third lip is designed to engage the third groove to provide relative longitudinal alignment between the nock receiver and the nock;

the first, second and third groove portions are substantially circumferentially equally spaced around the one of the nock and the nock receiver;

the first, second and fourth fingers are substantially circumferentially equally spaced around the other of the nock and the nock receiver;

fifth and sixth fingers: (a) extend from the other of the nock and the nock receiver; and (b) are non-flexible;

the fifth finger is positioned circumferentially between the first and fourth fingers when the nock receiver and the nock are rotationally and longitudinally aligned; and the sixth finger is positioned circumferentially between the second and fourth fingers when the nock receiver and the nock are rotationally and longitudinally aligned.

15. An arrow nock and nock receiver assembly comprising:

a nock comprising: a longitudinal axis and a bowstring reception surface designed to receive a bowstring to fire an associated arrow;

a nock receiver comprising a longitudinal axis and a first connection surface designed to connect the nock receiver to the associated arrow;

first and second groove portions formed on one of the nock and the nock receiver;

a first finger: (1) formed on the one of the nock and the nock receiver; and (2) circumferentially positioned between the first and second groove portions; and second and third fingers that: (a) extend from the other of the nock and the nock receiver;

and (b) have lips sized and shaped to be received in the first and second groove portions, respectively;

wherein:

(1) the first finger is designed to be circumferentially positioned between the second and third fingers to provide relative rotational alignment between the nock receiver and the nock; and (2) the lips of the second and third fingers are designed to engage the first and second groove portions, respectively, to provide relative longitudinal alignment between the nock receiver and the nock.

16. The arrow nock and nock receiver assembly of claim 15 wherein:

the nock comprises an extension having a connection surface with a circular cross-section;

the nock receiver comprises a second connection surface defined by an opening with a circular cross-section; and the nock connection surface is received within the nock receiver opening when the nock receiver and the nock are rotationally and longitudinally aligned.

17. The arrow nock and nock receiver assembly of claim 15 wherein:

the nock comprises an extension having a connection surface with at least one planar portion and at least one curved portion;

the nock receiver comprises a second connection surface defined by an opening with at least one planar portion and at least one curved portion; and the planar portion of the nock connection surface engages the planar portion of the opening and the curved portion of the nock connection surface engages the curved portion of the opening when the nock receiver and the nock are rotationally and longitudinally aligned.

18. The arrow nock and nock receiver assembly of claim 15 wherein:

the first and second groove portions are formed on an outer surface of the nock;

the second and third fingers extend longitudinally from the nock receiver; and the lips are positioned at distal ends of the first and second fingers and extend inwardly.

19. The arrow nock and nock receiver assembly of claim 15 wherein:

a third groove portion is formed on the one of the nock and the nock receiver;

a fourth finger: (a) extends from the other of the nock and the nock receiver; and (b) has a third lip sized and shaped to be received in the third groove portion;

the third lip is designed to engage the third groove to provide relative longitudinal alignment between the nock receiver and the nock;

the first, second and third groove portions are substantially circumferentially equally spaced around the one of the nock and the nock receiver; and the second, third and fourth fingers are substantially circumferentially equally spaced around the other of the nock and the nock receiver.

20. The arrow nock and nock receiver assembly of claim 15 wherein:

a third groove portion is formed on the one of the nock and the nock receiver;

a fourth finger: (a) extends from the other of the nock and the nock receiver; and (b) has a third lip sized and shaped to be received in the third groove portion;

the third lip is designed to engage the third groove to provide relative longitudinal alignment between the nock receiver and the nock;

the first, second and third groove portions are substantially circumferentially equally spaced around the one of the nock and the nock receiver;

the second, third and fourth fingers are substantially circumferentially equally spaced around the other of the nock and the nock receiver;

a fifth finger is: (1) formed on the one of the nock and the nock receiver; and (2) circumferentially positioned between the first and third groove portions; and a sixth finger is: (1) formed on the one of the nock and the nock receiver; and (2) circumferentially positioned between the second and third groove portion.

* * * * *